US005339549A

United States Patent [19]

David et al.

[11] Patent Number: 5,339,549

[45] Date of Patent: * Aug. 23, 1994

[54] BEVERAGE IDENTIFICATION TAGS FOR CUP HANDLES

[76] Inventors: George David; Rose H. David, both of 1822 Andoa La., Mt. Prospect, Ill. 60056

[ * ] Notice: The portion of the term of this patent subsequent to Nov. 16, 2010 has been disclaimed.

[21] Appl. No.: 129,466

[22] Filed: Sep. 30, 1993

[51] Int. Cl.[5] ..... G09F 3/00

[52] U.S. Cl. ..... 40/324; 40/666; 283/74; 283/114

[58] Field of Search ..... 40/306, 310, 316, 324, 40/658, 665, 666; 283/72, 74, 56, 114

[56] References Cited

U.S. PATENT DOCUMENTS

| | | | |
|---|---|---|---|
| 2,835,057 | 5/1958 | Mathews | 40/324 |
| 2,879,613 | 3/1959 | De Mario | 40/324 |
| 4,180,284 | 12/1979 | Ashley | 283/74 X |
| 4,899,474 | 2/1990 | Piana et al. | 40/316 |
| 5,261,176 | 11/1993 | David et al. | 40/324 |

FOREIGN PATENT DOCUMENTS

| | | | |
|---|---|---|---|
| 2655958 | 6/1978 | Fed. Rep. of Germany | 40/316 |
| 11352 | 5/1906 | United Kingdom | 40/324 |

*Primary Examiner*—Brian K. Green
*Attorney, Agent, or Firm*—Charles F. Lind

[57] ABSTRACT

The disclosed tag system is comprised of a plurality of split ring tags each having sufficient stiffness to normally retain its opposed end edges aligned, maintaining a gap therebetween smaller than a handle cross section, and having resilience and a shape memory to allow manual tag flexing so as to allow any tag to be fitted onto or remove it from the container handle. Each tag opening is irregular, being defined by first and second alternated contour edges on the split ring body, whereby the first contour edges, if continuous, would define a first large opening and the second contour edges, if continuous, would define a second opening smaller than the first opening. The second contoured edges is defined by projections suited to be flexed as needed to fit against the handle as the tag is positioned on the handle, making the tag useable on handles over a range of different sizes and shapes between the first and second openings.

1 Claim, 1 Drawing Sheet

BEVERAGE IDENTIFICATION TAGS FOR CUP HANDLES

BACKGROUND OF THE INVENTION

Our earlier invention of the same title, to be issued on Nov. 16, 1993 as U.S. Pat. No. 5,261,176 from copending application filed Jan. 21, 1992 with Ser. No. 07/823,175, related to different tag structures suited to be removably secured to a container handle for providing visual identification under a preconceived code of the contents or beverage held within the container. These tag structures or system can be used in restaurants, cafeterias, or other food eating establishments to convey specific refill information to the server, even if the different possible beverages cannot be distinguished visually, and without any verbal communication from the customer.

The patented tag system utilized groups of separate tags, where all tags within any group were visually the same and where the tags of each group were visually distinct. Shapes, colors and/or markings of the tags provide for group distinctness. The container on which the tag system will be used is commonly a drinking cup or mug, where the handle is comprised as a closed loop defining a finger opening and having a cross-section comfortable for the finger gripping.

Each tag had an elongated narrow body shaped somewhat uniformly over substantially a full 360 degrees to separate end edges, defining a split ring enclosed tag opening, where each unflexed tag lies in a plane and presented its end edges aligned opposite but closely adjacent one another with a gap therebetween. The tag bodies are formed of a degradable paper, thin in the direction axially of the tag opening but yet providing sufficient stiffness and shape memory to hold any tag in and return it generally to its unflexed configuration, while yet offering sufficient resiliency to be flexed laterally to increase the gap and fit the tag onto or remove it from the container handle. The gap of the unflexed tag is smaller than the handle cross section, for trapping the tag on the container handle.

One drawback to this tag construction has been the compromise of selecting a singular tag size able to work with many different containers, be they drinking cups, mugs or pitchers, in order to hold down the inventory of different tags needed, while yet providing a viable identification system. Each split ring tag thus had an overall outer dimension and a smaller inner dimension sized to fit over a selected handle cross section, while allowing the tag when unflexed to return to the generally planar configuration with the end edges aligned and opposite one another. The same sized tag when fitted on any significantly smaller handle will dangle loosely.

It has been determined that a preferred tag-handle fit is somewhat snug, to provide that the tag when positioned initially on the handle will not shift freely along the handle while the person is holding the cup or mug and drinking from it.

SUMMARY OF THE INVENTION

This invention relates to a tag system for visually identifying a beverage in a handled container, such as a drinking cup or mug.

The main object of the present invention is to provide improved tag constructions having a snug tag fit on container handles, differing over a wide range possibly in size and shape, for thereby offering a viable visual beverage identification system while reducing the needed inventory of different size tags.

To achieve this and other objects, the tag system is comprised of a family of separate split ring tags, each defining a substantially enclosed first opening larger than the cross section of the container handle and when unflexed being generally planar with its end edges adjacent to one another across a gap smaller than the cross section of the container handle, and each further having sufficient resilience and shape memory to withstand manual tag flexing laterally to increase the gap and allow the tag to be fitted onto or removed from the container handle. The improved tag has an irregular inside dimension defined by an overall large generally regular edge and several projections directed inwardly therefrom toward the tag center to provide an overall smaller second opening sized approximately the same as the smallest cross section of a handle on which the tag system might be used. The projections on the improved tag would thus fit snuggly on any container handle sized between the first and second openings, being folded over or collapsed by contact against the actual handle on which the tag is used.

BRIEF DESCRIPTION OF THE DRAWINGS

Further objects, advantages and features of the present invention will appear from the following disclosure and description, including as a part thereof the accompanying drawing, in which.

DETAILED DESCRIPTION OF ILLUSTRATED EMBODIMENTS OF THE INVENTION

Figure 1:
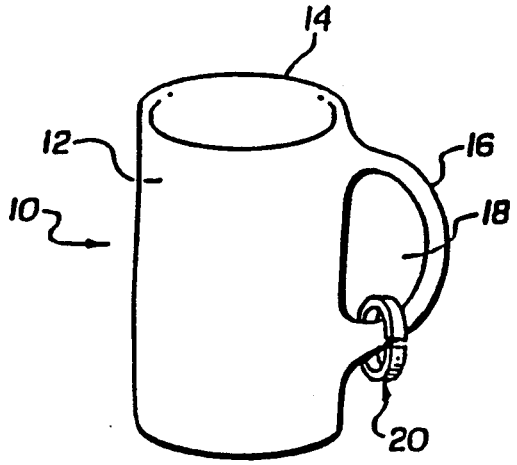
FIG. 1 is a perspective view of a typical drinking cup, with one embodiment of the above-identified patented identification tag mounted in place on the cup handle.
Figure 2:
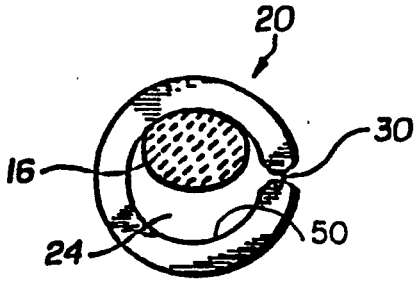
FIG. 2 is a sectional view of the cup handle of FIG. 1, illustrating the identification tag thereon.
Figure 4:
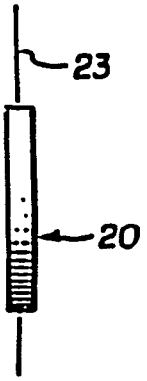
FIGS. 4 and 5 are side elevational views of the identification tag of FIG. 5, FIG. 4 illustrating it in its normal condition and FIG. 5 illustrating it in its flexed condition to allow it to be easily put on or taken from the handle.

FIG. 1 shows a cup or mug type container 10 having a continuous side wall 12 terminating at an upper drinking rim 14, and a handle 16 formed off of the side wall defining an opening 18 sized to receive one or more fingers of its user, for holding the cup.

Depending on the style and size of the cup 10 or of any other container such a pitcher, the handle 16 typically will have a cross-section between approximately $\frac{1}{4}$ and $\frac{3}{4}$ inch across. The illustrated handle cross section is rounded but not round, being wider in the horizontal direction than in the vertical direction at right angles thereto.

The patented tag system used a family of distinct tags adapted to be mounted or hung in place on the container handle by the customer or server for identifying the beverage contained or to be contained in the container.

The tags of a family are visually distinct, and tags 20,120, 220 and 320 are illustrated. The tag 20 of FIGS. 2–5 was illustrated in the above-identified patent and is generally circular; while the improved tags 320 of FIGS. 6–9 is also circular, and the tag 120 of FIG. 10 is generally triangular, and tag 220 of FIG. 11 is generally square.

Figure 10:
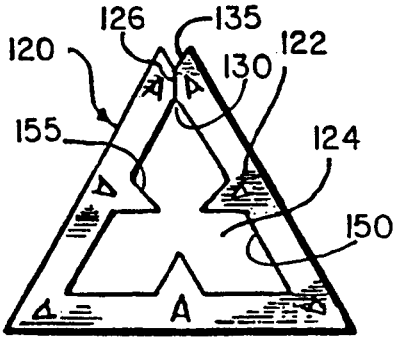
FIGS. 10 and 11 are views respectively similar to FIG. 6, but of second and third embodiments of the improved identification tag.
Figure 11:
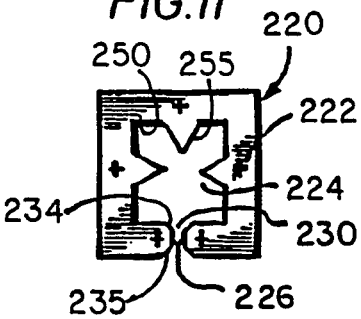

Other ways of distinguishing the tags include making the tags of different colors (not shown) and/or having different indicia imprinted on the exposed tag faces, as illustrated as letter "A" at 122 and as sign "+" at 222 in FIGS. 10 and 11 respectively.

In practice, one family of distinguishing tags could be defined by using different tag shapes only, such as a three member family using the three shapes illustrated. Other tag families could have the same shape, such as all being circular, and different tag colors might be used to define one family and different tag indicia might be used to define another family. Moreover, the distinguishing family characteristics of different tag shapes and/or tag colors and/or tag indicia could be combined, and coded by the server for communicating information identifying an even broader selection of beverages. Of importance, once a coded communication system of tags and associated beverages were established, a number of each different tag would typically be provided, virtually identical to one another, allowing the system to be used universally or repeatedly.

Each of the tags 20 (and 120, 220 and 320, although not illustrated) normally lies substantially along a plane (23 see FIG. 4), and has an elongated narrow body curved or extended over substantially a full 360 degrees and defining a substantially enclosed opening 24 (124, 224 and 324) larger than the cross section of the container handle, and having end edges 26 (126, 226 and 326) that lie proximate one another in the form of a split ring.

The tag body is formed of a degradable paper having both resilience and shape memory. The elongated tag body has sufficient strength and stiffness between its ends for normally retaining the end edges aligned opposite one another, with a gap 30 (and 130, 230 and 330) therebetween smaller than the cross section of the handle 16.

Figure 5:
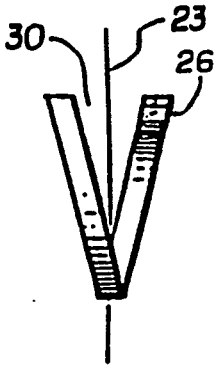
Figure 3:
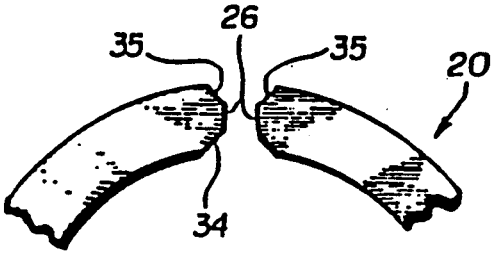
FIG. 3 is an enlarged frontal elevation of the ends of the identification tag of FIGS. 1 and 2.

The tag body however can be manually flexed to shift the end edges 26 (and 126, 226 and 326) laterally out of the plane 23 (as illustrated in FIG. 5) to increase the size of the gap 30 to something larger than the cross section of the container handle 16, and thereby allowing the tag to be fitted onto or pulled off of the handle.

When the tag ends have been positioned past the container handle 16 and the container handle lies within the tag opening 24 (and 124, 224 or 324), releasing the tag allows it to return to its normal generally planar configuration and become trapped on the handle; and the tag would remain so positioned unless intentionally removed or pulled off.

The tag end edges 26, 126, 226 and 326 are formed to lie generally parallel to one another, aligned radially or outwardly of the defined tag opening. Where the tag end edges are formed along the mid-section of a slightly curved or generally straight section of the elongated tag body, tapered edges 34, 35 and 234, 235 (see FIGS. 3 and 11) are formed inside and outside respectively of the end edges. This allows the user to align the tag gap at the handle easily, when the tag is to be fitted onto or pulled off of the handle. Where the tag ends 126 are formed at corners between generally straight sections of the elongated tag body, only outside tapered edges 135 need be formed (see FIG. 10).

The patented tag identification system would be practiced in either of two typical modes of use. In situations where the server obtained an initial verbal order from the customer of a selected beverage and thereafter brought the filled beverage cup to the customer, the server generally would place the tag on the cup. Alternatively, in situations where an empty cup were in place at the customer's table, a supply of the tags and information describing the corresponding tag-beverage code would also be provided, whereupon the customer would or could put the proper tag on the handle for the selected beverage and the server thereupon could fill and refill the cup via this communicated visual signal.

The tag would be removed from the container handle after use, when the container is to be washed. A plastic tag would be more durable and could be reused; but it may not be preferred as it could clog dishwasher drains should it inadvertently be left on the container handle after use. A paper tag would be inexpensive and disposable and might be preferred, as even if it inadvertently were left on the handle after use it should not cause drain clogging problems when compared to the already substantial acceptable use of paper napkins in public or commercial food eating establishments.

A circular or elliptical tag shape, or a five or six sided polygon, might be preferred as each generally defines a large enclosed opening compared to the overall exterior size of the tag.

Selected colors of particular interest would be brown and orange, corresponding to the pot colors already used for regular and decaffeinated coffee. Green might be used to correspond to tea.

It will be noted that the inside dimension of the tag 20 (FIGS. 1–5) as originally disclosed in the above-identified patent is circular and has a smooth inner edge 50, and moreover the edge is sized to fit on the handle 16; and the illustrated tag-handle fit shows clearance between most of the tag edge and handle. The tag 20 is thereby usable on larger handles up to where the handle binds against the inner tag edge 50 at least along two generally opposed locations. Instead, the illustrated tag 20 merely contacts the upper portion of the handle 16, and dangles freely from the handle 16 and can slide freely along the handle as the cup is lifted and tilted.

The improved tag to be disclosed now provides for making the inside tag edge irregular, as by providing an overall regular portion 350 (FIGS. 6–9) and several pointed projections 355 directed inwardly therefrom toward the center of the tag to lie in closer proximity of one another and thereby define an overall smaller opening, which would be approximately the same size as the smallest handle on which the tag system might commonly be used. The inner regular edge 350 of the circular tag 320 is intentionally illustrated as identical to the inner edge 50 of the circular tag 20, and the handles 16 are likewise identical in size and shape.

Figure 7:
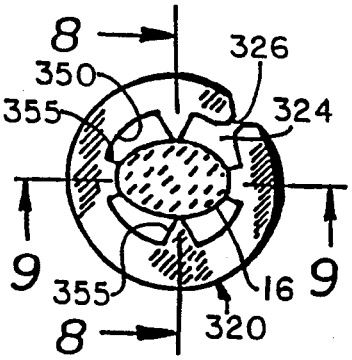
FIG. 7 is a sectional view of the cup handle of FIG. 1, similar to FIG. 2, but illustrating the identification tag of FIG. 6 thereon.
Figure 8:
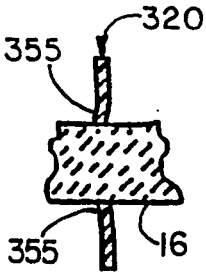
FIGS. 8 and 9 are sectional views as seen respectively from lines 8—8 and 9—9 of FIG. 7.
Figure 9:
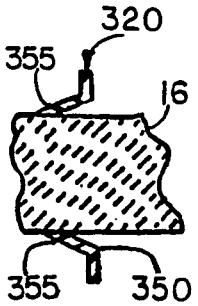

The operation of the projections 355 is illustrated in FIGS. 7–9, where they would generally bind against the handle, being folded over as needed from along their bases, which lie somewhat along the interrupted contour of the inner tag edge. Thus, in FIGS. 8 and 9 the opposite pairs of tab projections are illustrated as being folded over, the pair engaged on the smaller vertical portion of the handle cross section being folded only slightly while the pair engaged on the larger horizontal portion of the handle cross section being folded over a much greater extent. Instead of dangling freely, the tag 320 thus becomes somewhat frictionally bound against the handle, to keep both from rotating freely or even sliding freely along the handle.

Figure 6:
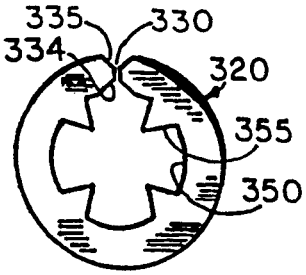
FIG. 6 is a frontal elevation of a first embodiment of identification tag as improved in this disclosure.

The tag 320 has been illustrated rotated from the orientation of FIG. 6 to have the projections lie generally on the smallest and largest portions of the handle cross section, but this is only for clarity and simplicity of disclosure. The same general action of having some or more extensive folding or collapse of the projections from the normal plane of the tag will occur, to the extent that the tag will be supported snugged on the handle, and over a much larger range of handle cross sections, differing in size and/or in shape.

This same projection concept is illustrated also in FIGS. 10 and 11 with the triangular and square tags 120 and 220 respectively, and the projections 155 and 255 extending inwardly from the regular inner tags edge 150 and 250 toward the tag center. The projections 155 and 255 would likewise reduce the effective inside dimension of the inner tag edge, thereby allowing either tag to be more snuggly fitted and held on handles of differing sizes and shapes.

While pointed projections have been illustrated, it would be possible to vary this shape. Further, the weaker portions of the tags, such as at the points, might crush down instead of folding the tag neatly over at a base line; but nonetheless the basic projection construction yields the same type of tag-handle engagement, compared to the unrestrained freedom of the patented tags. The same overall size tag of this invention thereby can be used on a wider range of handle sizes and shapes, reducing the inventory needs for providing a viable identification system.

While specific embodiments of the invention have been illustrated, variations may be made therefrom without departing from the inventive concept. Accordingly, the invention is to be limited only by the following claims.

What is claimed is:

1. A tag system comprised of groups of separate tags, all tags within any group being visually substantially identical to one another and the tags of each group being visually distinct from the tags of other groups; each tag of each of the groups having a thin planar split ring body shaped to extend over substantially a full 360 degrees and defining a substantially enclosed tag opening and presenting aligned end edges separated by a tag gap therebetween; each tag body having sufficient stiffness and shape memory axially of the tag opening to keep the tag generally in and return it to its unflexed planar configuration and having sufficient resiliency to allow manual flexing laterally out of the planar configuration to vary the tag gap; the tag system being suited for visual coded identification by specific tag groups of specific beverages held or to be held in containers of varied design and size but otherwise having a closed loop handle defining a finger opening and gripping cross-section, each tag gap being larger than the handle cross section when the tag is flexed allowing the tag to be fitted onto or removed from the container handle and the tag gap being smaller than the handle cross section when the tag is unflexed for trapping the tag on the container handle; and each tag being free from any connection to any bag of a type normally held in the container for forming the beverage, suited to remain trapped on the container handle when drinking from the container, each of the tags further including a plurality of foldable projections extending inwardly into the tag opening from an inner edge of the ring body, the foldable projections suited to be flexed transversely from the planar configuration, as needed to allow the tags to be used on different sized handles while providing a snug-handle fit.

* * * * *